United States Patent [19]

Skoog

[11] 4,303,123

[45] Dec. 1, 1981

[54] PLATE HEAT EXCHANGER

[75] Inventor: Malte Skoog, Lund, Sweden

[73] Assignee: Alfa-Laval AB, Tumba, Sweden

[21] Appl. No.: 55,698

[22] Filed: Jul. 9, 1979

[30] Foreign Application Priority Data

Jul. 10, 1978 [SE] Sweden ..... 7807675

[51] Int. Cl.[3] ..... F28F 3/08

[52] U.S. Cl. ..... 165/166

[58] Field of Search ..... 165/146, 147, 166, 167

[56] References Cited

U.S. PATENT DOCUMENTS 2,623,736 12/1952 Hytte ..... 165/166
3,106,243 10/1963 Knudsen ..... 165/167
3,372,744 3/1968 Skoog ..... 165/167

FOREIGN PATENT DOCUMENTS 1275130 5/1972 United Kingdom ..... 165/167

*Primary Examiner*—Sheldon J. Richter
*Attorney, Agent, or Firm*—Cyrus S. Hapgood

[57] ABSTRACT

In a plate heat exchanger in which the flow rates of the two heat exchanging fluids are different, it is possible to obtain an adjustment to differing proportions of the fluid flows, the pressure drops being given. To this end, the heat exchanger is provided with at least two sections of heat exchanging passages, in at least one of said sections the passages for the two respective fluids having essentially different flow resistances. Furthermore, the proportion of the flow resistances of the passages for the respective fluids in one section differs essentially from the corresponding proportion in at least one other section.

1 Claim, 2 Drawing Figures

PLATE HEAT EXCHANGER

The present invention relates to a heat exchanger of the kind comprising a plurality of heat exchanging plates arranged adjacent to each other and forming between them sealed passages adapted to receive two heat exchanging fluids flowing therethrough.

In cases where the flow rates of the two heat exchanging fluids differ from each other, it is desirable to provide heat exchanging passages which, at a given pressure drop, allow different large flows (i.e., which have different flow resistances). The fluid having the larger flow rate is then allowed to flow through passages with low flow resistance, while the fluid having the smaller flow rate is allowed to flow through passages having a higher flow resistance. A heat exchanger designed in this way is suitable for use at a certain predetermined proportion between the flow rates of the two heat exchanging fluids but is not suitable if the flow rates differ essentially from said predetermined proportion.

With reference to the above, it is an object of the present invention to provide a heat exchanger which can be adapted to several different proportions of the flow rates of the two heat exchanging fluids.

According to the present invention, this object is achieved by a heat exchanger of the above-mentioned kind which is generally characterized in that it comprises at least two sections of heat exchanging passages, the passages for the two respective fluids in at least one of said sections having essentially different flow resistances, the proportions of the flow resistances of the passages for the respective fluids in one section differing essentially from the corresponding proportion in at least one other section.

In this connection, the expression "essentially different flow resistances" relates to a proportion between the two fluid flow rates which at equal pressure drops is at least 1.2:1.

Figure 1:
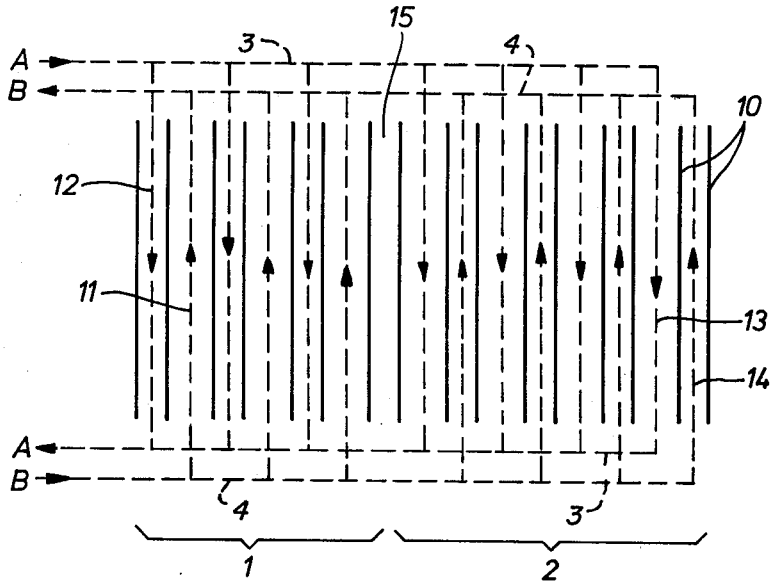
Figure 2:
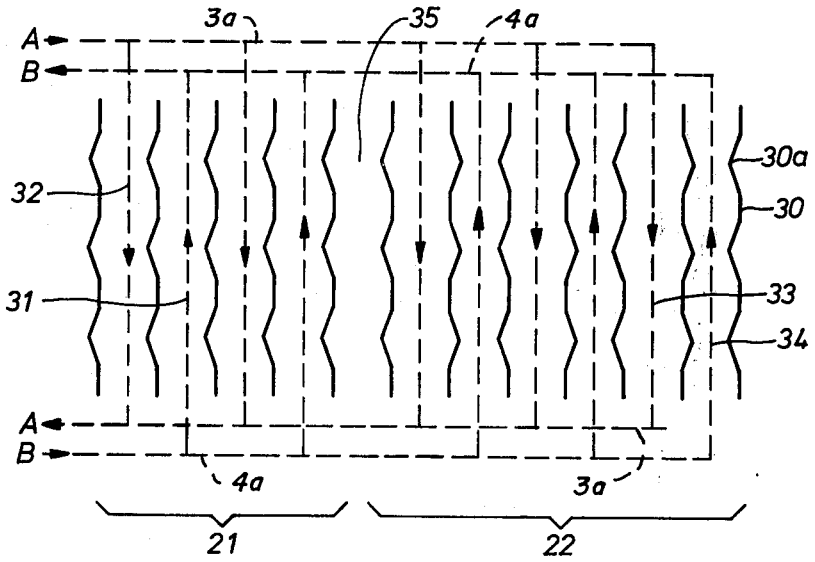

The invention will be described more in detail below with reference to the accompanying drawing, in which FIGS. 1 and 2 illustrate diagrammatically two different embodiments of the heat exchanger according to the invention.

The heat exchanger shown in FIG. 1 comprises two sections 1 and 2, each of which comprises a series of heat exchanging plates 10. The plates 10 are shown as arranged with different interspaces, whereby heat exchanging passages 11–14 are formed between the plates, said passages being of different widths and disposed alternately. The passages 11 and 13 are thus shown wider than the passages 12 and 14, which is intended to indicate that passages disposed adjacent to each other have different flow resistances. The wider passages 11 and 13 may have equal or different flow resistances, and the flow resistances of the narrower passages 12 and 14 may also be equal or different.

It will be understood that each of the heat exchange passages 11–14 is confined by marginal gaskets (not shown) compressed between each pair of adjacent plates, as is conventional.

The two heat exchanging fluids are designated A and B in FIG. 1, and their flow paths are indicated by broken lines. As will be understood from FIG. 1, the horizontal broken lines 3 represent duct means connecting the narrower passages 12 in section 1 in parallel with the wider passages 13 in section 2, and the horizontal broken lines 4 represent duct means connecting the wider passages 11 in section 1 in parallel with the narrower passages 14 in section 2. As appears from FIG. 1, fluid A flows through the narrower passages 12 of section 1 and through the wider passages 13 of section 2. For fluid B the arrangement is reversed so that fluid B flows through the wider passages 11 of section 1 and through the narrower passages 14 of section 2. The two heat exchanger sections 1 and 2 are separated by a passage 15 to which neither of the fluids is admitted.

In the examples 1–3 given below, it is assumed that the flow resistances of the wider passages 11 and 13 are equal and likewise that the flow resistances of the narrower passages 12 and 14 are equal. It is further assumed that the total number of heat exchanging passages for each of the fluids A and B is 100 and that under certain given optimal conditions of operation, the flow rate in each passage 11 and 13 is 2 $m^3/h$ and in each passage 12 and 14 is 1 $m^3/h$.

EXAMPLE 1

If the flows of fluids A and B are 150 $m^3/h$ each and thus equal, the heat exchanger is arranged in such way that each section 1 and 2 comprises 50 passages for each fluid. Of fluid A, 50 $m^3/h$ will then pass through section 1 and 100 $m^3/h$ through section 2, which together makes 150 $m^3/h$. For fluid B the arrangement is reversed, i.e., 100 $m^3/h$ passes through section 1 and 50 $m^3/h$ through section 2, but the total flow is the same, namely 150 $m^3/h$.

EXAMPLE 2

The flows of fluids A and B are assumed to be 175 and 125 $m^3/h$, respectively. To accommodate these flows, section 1 is provided with 25 passages and section 2 with 75 passages for each fluid. Of fluid A, 25 $m^3/h$ then passes through section 1 and 150 $m^3/h$ through section 2, thus together 175 $m^3/h$. Of fluid B, 50 $m^3/h$ passes through section 1 and 75 $m^3/h$ through section 2 which together makes 125 $m^3/h$.

EXAMPLE 3

In this case, the flows A and B are assumed to be 200 and 100 $m^3/h$, respectively. The proportion of these flows is thus the same as that of the flows in the passages 11 and 12. These flows are accommodated by arranging the heat exchanger so that the number of passages of each kind in section 1 and 2 will be zero and 100, respectively. Thus, section 1 is omitted. The fluid A passes through passages 13 and fluid B through passages 14.

It should be apparent from the above examples that the plate heat exchanger is adaptable to heat exchanging duties in which the proportion of the flows of heat exchanging fluids varies within wide limits which are set by the proportion of the flows in the two involved types of heat exchanging passages at given operational conditions. Thus, in the above examples the proportion of the flows A and B can be allowed to vary between the limits 2:1 and 1:2.

The limits within which the flows A and B can be allowed to vary under optimal operational conditions can be altered by adapting the flow resistances of the heat exchanging passages in both sections 1 and 2. In the examples given below, it is assumed that the wider passages 11 and 13 at optimal operational conditions allow a flow of 2.5 and 2.0 $m^3/h$, respectively, and that the narrower passages 12 and 14 at the same conditions allow a flow of 1 and 1.5 $m^3/h$, respectively. The total number of passages for each fluid is assumed to be 100.

EXAMPLE 4

The flows A and B are assumed to be 150 and 200 $M^3/h$, respectively. To accommodate these flows, sections 1 and 2 are each provided with 50 passages for each fluid. Of fluid A, 50 $m^3/h$ passes through section 1 and 100 $m^3/h$ through section 2, which together makes 150 $m^3/h$. Of fluid B, 125 $m^3/h$ passes through section 1 and 75 $m^3/h$ through section 2, thus together 200 $m^3/h$.

EXAMPLE 5

The flows A and B are assumed to be 125 and 225 $m^3/h$, respectively. Section 1 is provided with 75 passages and section 2 with 25 passages for each fluid. Of fluid A, 75 $m^3/h$ passes through section 1 and 50 $m^3/h$ through section 2, i.e., together 125 $m^3/h$. Of fluid B, 187.5 $m^3/h$ passes through section 1 and 37.5 $m^3/h$ through section 2, thus together 225 $m^3/h$.

With the flow resistances of the passages assumed in examples 4 and 5, the limits of the ratio of the flows A and B will be 1:2.5 and 2:1.5. These limits correspond to the proportion of the flows in passages 11 and 12 in section 1 and in passages 13 and 14 in section 2, respectively.

The heat exchanger illustrated diagrammatically in FIG. 2 comprises two sections 21 and 22, each having a number of heat exchanging plates 30. The sections 21 and 22 are separated by an empty passage 35. The plates 30 are provided on one side with protrusions 30*a* for generating turbulence. As appears from FIG. 2, all the plates of section 21 face the same direction, whereas in section 22 every second plate faces the opposite direction. The heat exchanging passages 31 and 32 of section 21 are thus identical, whereas the passages 33 and 34 of section 22 are different in volume and flow resistance. In FIG. 2, the duct means 3*a* and 4*a* correspond to the duct means 3 and 4, respectively, in FIG. 1.

Even this embodiment of the heat exchanger is adaptable to different flows of the heat exchanging fluids, as illustrated by the following examples in which it is assumed that the heat exchanger comprises a total number of 100 passages for each fluid and that the flow through each passage 31 and 32 is 1.5 $m^3/h$ through the passages 33 and 34 is 2 and 1 $m^3/h$, and respectively, under the same conditions as in the above examples.

EXAMPLE 6

The flows are assumed to be 175 $m^3/h$ of fluid A and 125 $m^3/h$ of fluid B. Each of the sections 21 and 22 is provided with 50 passages for each fluid. Of each fluid 75 $m^3/h$ passes through section 21. These flows will of course be equally large, since all passages of section 21 are equal. Through section 22 passes 100 $m^3/h$ of fluid A and 50 $m^3/h$ of fluid B, and the total flows of A and B will thus be 175 and 125 $m^3/h$, respectively.

EXAMPLE 7

The flows A and B are assumed to be 160 and 140 $m^3/h$, respectively. To accommodate these flows, sections 21 and 22 are provided with 80 and 20 passages, respectively, for each fluid. Of each fluid 120 $m^3/h$ flows through section 21, and in section 22 the flows of A and B will be 40 and 20 $m^3/h$, respectively. Thus, the heat exchanger is exactly adapted to the present flows of 160 and 140 $m^3/h$, respectively.

As is easily understood, the heat exchanger according to Examples 6 and 7 is adaptable to different proportions of the flows A and B within the limits 1:1 and 2:1. If the number of passages in section 21 is increased at the expence of the number of passages in section 22, the proportions approach the first mentioned limit. If the number of passages in section 22 is instead increased at the expense of the number in section 21, the proportions approach the last mentioned limit 2:1.

Correspondingly, in all the above examples it is true that when the number of passages in one heat exchanger section is increased at the expense of the other section, the proportion of the flows approaches the limit determined by the proportions of the flows in the individual passages in said one section. The limits may be changed in turn as required by selecting suitable flow resistances of the passages for each fluid in each of the heat exchanger sections.

It should be apparent from the above that the heat exchanger according to the invention is accurately adaptable to different flows of heat exchanging fluids without rejecting the demand for operating the apparatus at optimal operational conditions, in order to make maximum use of the pressure drop. If desired or required, the heat exchanger may be provided with more than two sections having mutually differing flow conditions. Furthermore, a separation plate of a conventional type may be used between the sections instead of the empty passage 15 or 35.

I claim:

1. A heat exchanger having at least two sections of heat exchanging plates, each section comprising a plurality of said plates arranged adjacent to each other and forming between them sealed passages adapted to receive two heat exchanging fluids flowing therethrough, said passages for the respective fluids in at least one of said sections having essentially different flow resistances, the proportion of the flow resistances of the passages for the respective fluids in one section differing essentially from the corresponding proportion of another section, means connecting the passages for one of said two fluids in a first said section in parallel with the passages for one of said two fluids in a second said section, and means connecting the passages for the other of said two fluids in said first section in parallel with the passages for the other of said two fluids in said second section, whereby the heat exchanger is adapted for parallel flows of the same two fluids through said first and second sections, said passages for the respective fluids in each of two said sections having essentially different flow resistances, the proportion of the flow resistances of the passages for the respective fluids in one section being equal to the inverted value of the corresponding proportion in another section.

* * * * *